US006946623B2

(12) United States Patent
Evanyk

(10) Patent No.: US 6,946,623 B2
(45) Date of Patent: Sep. 20, 2005

(54) APPLIANCE FOR LIQUEFYING SOLDER WITH VARIABLE DUTY CYCLE AND METHOD OF IMPLEMENTING

(75) Inventor: Walter Evanyk, Plano, TX (US)

(73) Assignee: PowerPulse Technologies, L.P., Richardson, TX (US)

( * ) Notice: Subject to any disclaimer, the term of this patent is extended or adjusted under 35 U.S.C. 154(b) by 0 days.

(21) Appl. No.: 10/442,026

(22) Filed: May 20, 2003

(65) Prior Publication Data

US 2004/0016741 A1 Jan. 29, 2004

Related U.S. Application Data

(60) Continuation-in-part of application No. 10/117,776, filed on Apr. 4, 2002, now Pat. No. 6,718,651, which is a division of application No. 09/662,860, filed on Sep. 15, 2000, now Pat. No. 6,449,870.

(51) Int. Cl.[7] ..... H05B 1/02
(52) U.S. Cl. ..... 219/240; 219/492
(58) Field of Search ..... 219/221, 229, 219/240, 241, 492

(56) References Cited

U.S. PATENT DOCUMENTS

| | | | | |
|---|---|---|---|---|
| 3,646,577 A | * | 2/1972 | Ernst | 219/241 |
| 3,651,413 A | | 3/1972 | Wycoff | |
| 3,990,622 A | | 11/1976 | Schurman, Jr. et al. | |
| 4,243,875 A | * | 1/1981 | Chang | 219/497 |
| 4,267,914 A | | 5/1981 | Saar | |
| 4,576,553 A | | 3/1986 | Winston et al. | |
| 4,590,363 A | | 5/1986 | Bernard | |
| 4,755,792 A | | 7/1988 | Pezzolo et al. | |
| 4,893,067 A | | 1/1990 | Bhagwat et al. | |
| 5,043,560 A | * | 8/1991 | Masreliez | 219/492 |
| 5,086,526 A | | 2/1992 | Van Marcke | |
| 5,117,091 A | | 5/1992 | Ely | |
| 5,143,272 A | | 9/1992 | Carlomagno et al. | |
| 5,260,548 A | * | 11/1993 | Todd et al. | 219/492 |
| 5,277,261 A | | 1/1994 | Sakoh | |
| 5,289,885 A | | 3/1994 | Sakoh | |
| 5,410,229 A | | 4/1995 | Sebastian et al. | |
| 5,440,215 A | | 8/1995 | Gilmore | |
| 5,446,262 A | * | 8/1995 | McCambridge | 219/229 |

(Continued)

*Primary Examiner*—Teresa J. Walberg
(74) *Attorney, Agent, or Firm*—Jones Day

(57) ABSTRACT

The present invention relates to a solder heating appliance with variable duty cycle. Rather than applying power continuously to the heating element, the element power is intermittently switched over to a variable duty cycle. Savings are gained in three areas: extended life of the element; less heat lost to thermal radiation; and less solder waste due to dripping and overheating. The variable duty cycle may be adjusted manually or automatically based on the temperature of the heating element, or tip. Additionally, the voltage and/or current to the heating element may be adjusted, either manually or automatically, for more rapid recovery during high usage periods. Higher throughput is achieved by sensing the temperature, comparing the temperature to a desired temperature, and then increasing the variable duty cycle by either or both one of increasing the frequency of duty pulses and/or lengthening the duration of the variable duty cycle.

19 Claims, 5 Drawing Sheets

U.S. PATENT DOCUMENTS 5,477,027 A 12/1995 Biro et al.
5,482,199 A 1/1996 Walker
5,495,093 A * 2/1996 Griffith ..... 219/241
5,526,460 A 6/1996 DeFrancesco et al.
5,569,400 A 10/1996 Lee
5,731,673 A 3/1998 Gilmore
5,937,622 A 8/1999 Carrier et al.
5,943,712 A 8/1999 Van Marcke
5,945,803 A 8/1999 Brotto et al.
6,010,228 A 1/2000 Blackman et al.
6,178,572 B1 1/2001 Van Marcke
6,242,889 B1 6/2001 Belyo
6,286,609 B1 9/2001 Carrier et al.
6,296,065 B1 10/2001 Carrier
6,327,428 B1 12/2001 Lo et al.
6,353,705 B1 3/2002 Capps et al.
6,406,168 B1 6/2002 Whiting
6,424,799 B1 7/2002 Gilmore
6,449,870 B1 9/2002 Perez et al.
6,460,626 B2 10/2002 Carrier
6,479,958 B1 11/2002 Thompson et al.
6,538,403 B2 3/2003 Gorti et al.

* cited by examiner

APPLIANCE FOR LIQUEFYING SOLDER WITH VARIABLE DUTY CYCLE AND METHOD OF IMPLEMENTING

CROSS REFERENCES TO RELATED APPLICATIONS

The present application is a continuation in part of and claims priority from the following U.S. patent applications:

U.S. patent application Ser. No. 10/117,776 entitled "Portable Hair Dryer" filed on Apr. 4, 2002 now U.S. Pat. No. 6,718,651, which is a divisional of Application Ser. No. 09/662,860 U.S. Pat. No. 6,449,870 entitled "Portable Hair Dryer" filed on Sep. 15, 2000. The above-identified applications are incorporated by reference herein in their entirety.

The present application is also related to the following co-pending U.S. Patent applications:

U.S. patent application Ser. No. 10/409,555 having entitled "Appliance for Dispensing Melt Adhesive with Variable Duty Cycle and Method of Implementing" and filed on Apr. 7, 2003; and U.S. patent application Ser. No. 10/410,978 having entitled "Dryer/Blower Appliance with Efficient Waste Heat Dissipation" and filed on Apr. 9, 2003, both currently pending.

BACKGROUND OF THE INVENTION

1. Field of the Invention

The present invention relates in general to a soldering appliance. More specifically, the present invention is related to a soldering appliance and a voltage regulating circuit to control the heat produced by the element, but it also has a power control circuit that allows the heating element to obtain full heat and then pulses it to maintain the set heat which reduces the power consumption.

2. Description of Related Art

Soldering is the use of a catalytic metal alloy which is liquefied below the workpiece melting point. It is a type of thermal joining process in which the molten filler metal alloy is drawn into a capillary gap between two closely fitting surfaces, sometimes referred to as "sweating" the capillary gap. Soldering is performed at temperatures below 842° F. (450° C.) which is below the melting point of the metals being joined. Solders with melting temperatures below 356° F. (180° C.) are defined as low melting temperature solders, between 392° F. and 446° F. (200° C.–230° C.) are mid range melting temperature solders and high melting temperature between 446° F. and 662° F. (230° C.–350° C.). These are referred to generically as "soft" solders. Intermediate temperature solders, named because it is the intermediate point between soldering and brazing, are any solders which melt above 662° F. (350° C.).

Electrical solder heating appliances allow an operator to apply a controlled application of narrowly directed heat onto a workpiece. Soldering applications include soldering/desoldering electrical components to one another, to printed circuit boards (PCBs), craft applications, and most soldering applications calling for more thermal control than a flame. Solder heating appliances generally take the physical form of a soldering iron, pencil, or "wand"-type, or a soldering "gun"-type appliance. A typical solder heating appliance comprises at least three main parts: the handle/body; the heater; and tip, although the tip may be considered a subpart of the heater. The most common soldering heater appliance is the soldering wand (or iron) which ranges in size from that of a small pencil to the diameter of a broomstick, and larger. Almost all solders are copper tipped, since copper's heat conductivity is extremely high for the cost of copper. The wand-type of solder heating appliance may be connected directly to a power by incorporating essentially all of the electrical components in the interior of the handle/body, or it may be connected to a base unit as part of a "soldering station" where bulkier electrical components are located in a remote base unit or console. Directly powered wand-type solder heating appliances typically utilize a resistive wire heating element (generally coiled) for generating heat. The heating element is positioned adjacent to the tip, thus the tip is indirectly heated by the heating element. Heat is produced by an electrical current flowing through the resistive wire of the coil. Temperatures at the tip may be substantially higher than is necessary for melting solder, but throughput in wand-type appliances with resistive coiled wire elements is generally limited by the amount of heat stored in the mass of the tip and heating element. Wand-type solder heating appliances range from 15 watts (W) to 100 W or more, but are generally wired as "always on" appliances because the slow heat-up characteristics of the coiled resistive wire heating element and their generally poor thermal recovery. U.S. Pat. No. 5,117,091 to Ely titled "Soldering Gun," which is incorporated herein by reference in its entirety, describes a typical wand-type soldering heating apparatus with an internal resistance heating element encapsulated in a clad iron tube and a removable tip.

Coiled wire heating elements, like most types of solder heating elements, are heated by increasing the amount of kinetic energy of the atoms in the heating coil through the application of an electrical current. The amount of power converted to heat is well understood as being approximately $I^2R$, where I is the current being applied and R is the internal resistance of the coil. The higher the current, the more heat. Furthermore, because the power delivered to the coil is EI, where E is the voltage being applied, the heat generated by the heating element can be substantially increased for the same power by reducing the voltage, E, and proportionally increasing the current, I. However, because step-down transformers are bulky and heavy, most directly wired wand-type appliances use unaltered power directly from the power source. Soldering stations, on the other hand, generally incorporate a transformer, or the like, in the base unit for increasing the current, while stepping down the voltage.

Aside from coil resistive wire heating elements, solder heating appliances make use of other technologies for heating, such as ceramic heating elements. Ceramic heating elements are somewhat more energy efficient than coiled wire elements and are far more temperature responsive. In general, however, they do not have the thermal response necessary for powering them down after each use. Some manufacturers have moved toward extremely lightweight wand-type appliances with extremely narrow tip configuration (pencil irons). These are far more responsive than the coiled wire type element, but due to their low mass, their throughput is often limited.

Solder stations house the heavy and bulky electrical components in a remote base unit so power capacity at the wand can be dramatically increased while actually reducing its weight. Furthermore, solder stations provide the space necessary for incorporating more useful soldering features such as temperature control, continuous solder feeding mechanisms and desoldering vacuum units. Solder stations are especially useful for production work because of their high power capacities and extensive soldering features. An exemplary soldering station is shown in U.S. Pat. No. 3,990,622 to Schurman, Jr. et al. entitled "Apparatus for soldering," which is incorporated herein by reference in its entirety.

Rarely, if ever, is a wand-type solder heating appliance thermostatically controlled unless it is connected to a soldering station. In general, the power of a wand-type soldering appliance is kept lower to reduce its weight and operating costs. Because most wand-type solder heating appliances are always on when connected to a power source, the superfluous heat is merely exhausted into the ambient environment, resulting in the wand-type appliance being extremely inefficient for its power. Thus, the wand-type solder heating appliance suffers from lower power, and therefore lower work throughput capacity, while simultaneously, suffering higher heat loss and the associated higher operating costs of the appliance.

Most gun-type solder heating appliances use a fast heating, thermally responsive type of heating element, wherein the tip itself, or resistive wire loop, is directly heated by the flow of electrical current through the wire loop. The heating current is trigger controlled and operates at substantially higher wattage than typical wand-type soldering appliances (e.g., 50 W to 150 W gun-type solder heating appliances are common and heavy-duty soldering guns have over 250 W of heating capacity). The wire loop tip generally operates at a much lower voltage than wand-type appliances, between 1 volt (V) and 10 volts, because the total resistance in the wire loop tip is much less than that found in the coiled heating resistive wire element of wand-type solder heating appliances. This is possible because the physical design of the body on a gun-type appliance will accommodate a moderately sized transformer, so stepping up the current is possible. It is also possible to balance the gun such that the added weight of the transformer does not influence soldering.

Heat loss is generally high at the wire loop tip, but also throughout all of the high current electrical components. The $I^2R$ losses of low voltage, high current circuit portion of a wire loop-type solder heating appliance are often much higher than the total $I^2R$ losses found in the entire electrical circuit of the wand-type. Moreover, the operating power of the gun-type appliance is usually much higher. These losses are ameliorated somewhat by including a trigger switch which the user selects for applying current to the tip, and thereby heating the appliance. Due to the high power output generated from high current and low tip mass, the wire loop tip of gun-type soldering appliances is prone to overheating failures due to the resistive wire loop reaching the point of incandescence. The wire loop may incandesce if left activated for as little as 20 seconds. Current may be applied to the wire loop tip for longer time periods while in continued use, thereby channeling the excess heat into liquefying the solder and keeping the tip just below the point of incandescence. Thus, the gun-type solder heating appliance suffers from proportionally higher external heat losses from the wire loop tip and additional internal $I^2R$ losses in the low voltage circuit and the associated higher operating costs, as well as a high incidence of tip failure due to the unregulated overheating of the wire loop tip. Various exemplary embodiments of a gun-type solder heating appliance are described in U.S. Pat. No. 5,569,400 to Lee entitled "Soldering gun with U-shaped insertable terminal structure and tip having differing impedance layers," as does U.S. Pat. No. 5,477,027 to Biro et al. entitled "Electrical soldering device with a split cylinder transformer secondary," both of which are incorporated herein by reference in their entireties.

Still another type of solder heating appliance is a desoldering appliance. Desoldering appliances are designed to heat unwanted solder located on the workpiece and extract the solder residue once liquefied. A typical desoldering appliance is shown in U.S. Pat. No. 5,143,272 to Carlomagno et al. entitled "Desoldering device," which is incorporated herein by reference in its entirety. Desoldering stations often comprise special hollow tip configurations with vacuum assist for extracting or sucking away the unwanted solder, and are commonly referred to as "solder suckers." The heating element in a solder sucker may be either the coiled resistive wire, ceramic or the resistive wire loop tip and suffers from the identical problems with the corresponding appliances as described above.

Portable solder melting appliances are known in the prior art with battery powered solder heating elements (cordless) which typically comprise coiled resistive wire heating elements. In an effort to extend battery life, cordless solder melting appliances are extremely low power, even less than the wand-type solder heating appliances described above. In fact, aside from a switch for turning, connecting and disconnecting the battery to the heating element, cordless solder melting appliances are very similar in design to the wand-type solder heating appliance and suffer from the identical shortcoming. Additionally, cordless solder melting appliances are severely under-powered.

Prior art solder melting appliances have focused largely on user conveniences and increased throughput without regard to operating efficiencies. One solution for increasing throughput is incorporating a heat sink at or near the tip. The heat sink absorbs latent heat which would otherwise be exhausted to the ambient air when the tip is at higher temperatures, for instance during idle periods when solder is not in contact with the tip, and then releases the heat energy to cold solder when in contact with the tip, such as during active periods when large volumes of solder are being applied to a workpiece. This feature was extremely common in soldering irons which relied on an outside heating source for their heat. However, the larger heat sink usually entails a larger surface to radiate heat into the ambient air, and therefore is usually far less efficient than a comparable solder heating appliance without the heat sink feature.

Another solution, as described above, is to lower the power output of the appliance. While lowering the power output does reduce the total amount of heat being exhausted into the surrounding air, lower throughput results in higher lag times, which in turn increases operating expenses due to the operator's increased idle time. Similarly, other efforts have been directed to reducing the mass of the heating element and tip, thereby increasing thermal response while lowering, somewhat, the power requirement. Each of these alternatives severely lower the appliance's throughput capacity.

Another energy saving measure devised by artisans in the prior art is to insulate the tip of the soldering appliance with a heat resistive thermal insulating cover, sometimes referred to as a "hot iron sock." Using the hot iron sock effectively is extremely cumbersome for the operator as he must sheathe and unsheathe the iron between uses. This solution has been largely relegated to service people who must move quickly from job to job. With the hot iron sock, they can pack their soldering appliance into a toolbox immediately after the soldering at one job is finished and move on to the next.

Power regulation in the prior art has been limited to switching the current to the heating element on and off. The electrical switching may be manually activated or automated via a temperature sensor such as a bimetal strip switch. U.S. Pat. No. 4,590,363 to Bernard entitled "Circuit for controlling temperature of electric soldering tool," which is incorporated herein by reference in its entirety, describes an automated switching circuit for controlling power to the heating element of a soldering iron based on a temperature signal received from a thermocouple. While the upper current level may be adjusted, such as for increasing the power output to the heating element, and tip temperature is controlled in prior art soldering appliances by opening the switch to the heating element when the sensed temperature rises above a predetermined temperature level, and closing the switch when the sensed temperature drops below another preset temperature level.

SUMMARY OF THE INVENTION

The present invention relates to a solder heating appliance with adjustable duty cycle. Rather that applying power continuously to the heating element, the element power is intermittently switched over a variable duty cycle. Savings are gained in three areas: extended life of the element; less heat lost to thermal radiation; and lower $I^2R$ losses in the internal circuitry. The duty cycle may be adjusted manually or automatically based on the temperature of the heating element or tip. Additionally, the voltage and/or current to the heating element may be adjusted manually or automatically for more rapid recovery during high usage periods. Higher throughput is achieved by sensing the temperature, comparing the temperature to a desired temperature, and then increasing the duty cycle by either or both one of increasing the frequency of duty pulses and/or lengthening the duration of the duty pulses.

BRIEF DESCRIPTION OF THE DRAWINGS

The novel features believed characteristic of the present invention are set forth in the appended claims. However, the invention itself, as well as a preferred mode of use, further objectives and advantages thereof, will be best understood by reference to the following detailed description of an illustrative embodiment when read in conjunction with the accompanying drawings wherein:

Other features of the present invention will be apparent from the accompanying drawings and from the following detailed description.

DETAILED DESCRIPTION OF THE INVENTION

Figure 1A:
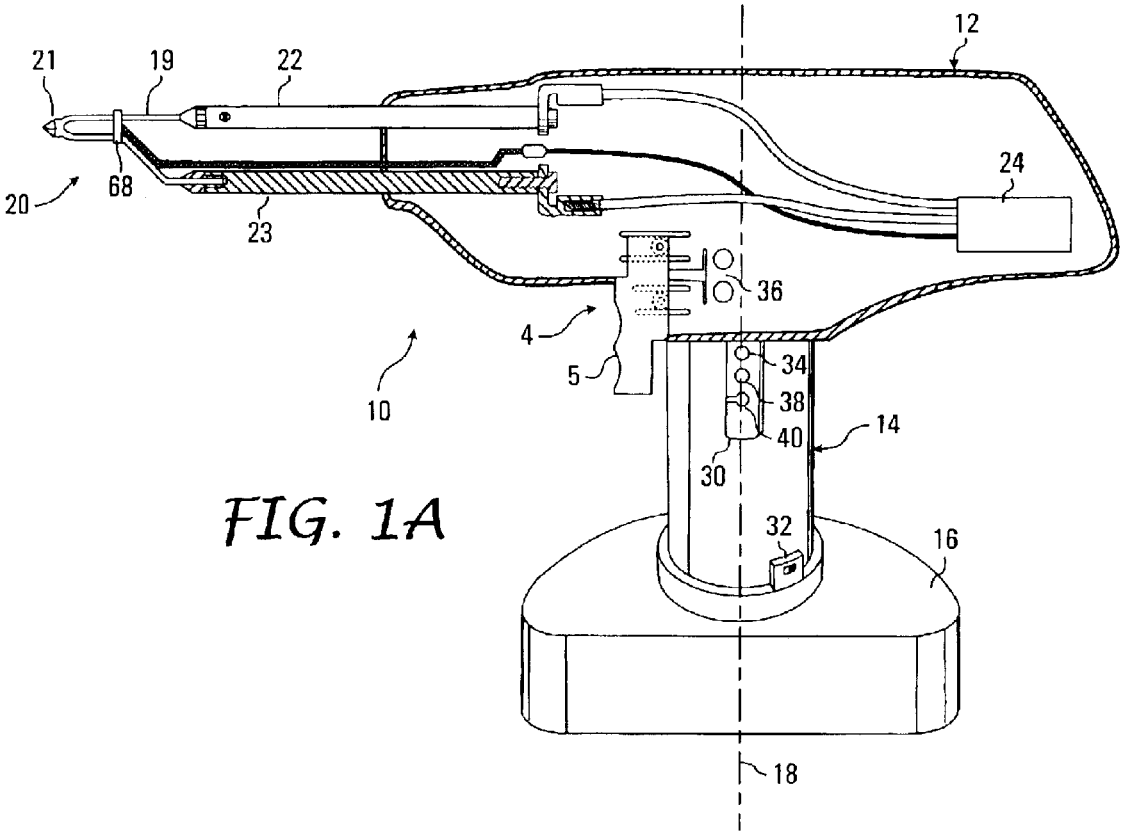
FIGS. 1A, 1B and 1C depict a solder heating appliance, physically configured as a gun-type, with a resistive loop-type solder heating element and a pulsing circuit in accordance with exemplary embodiments of the present invention.
Figure 2A:
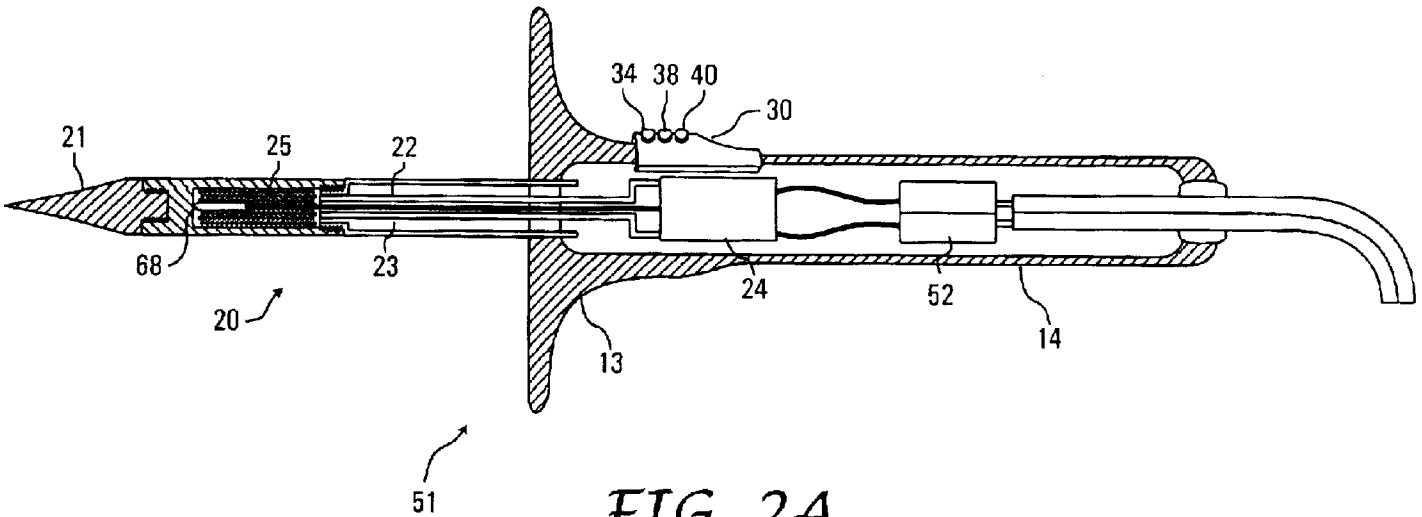
FIG. 2A and 2B depict a solder heating appliance physically configured as a wand-type appliance with both a resistive coiled resistive wire heating element and a ceramic heating element and a pulsing circuit in accordance with exemplary embodiments of the present invention.
Figure 3:
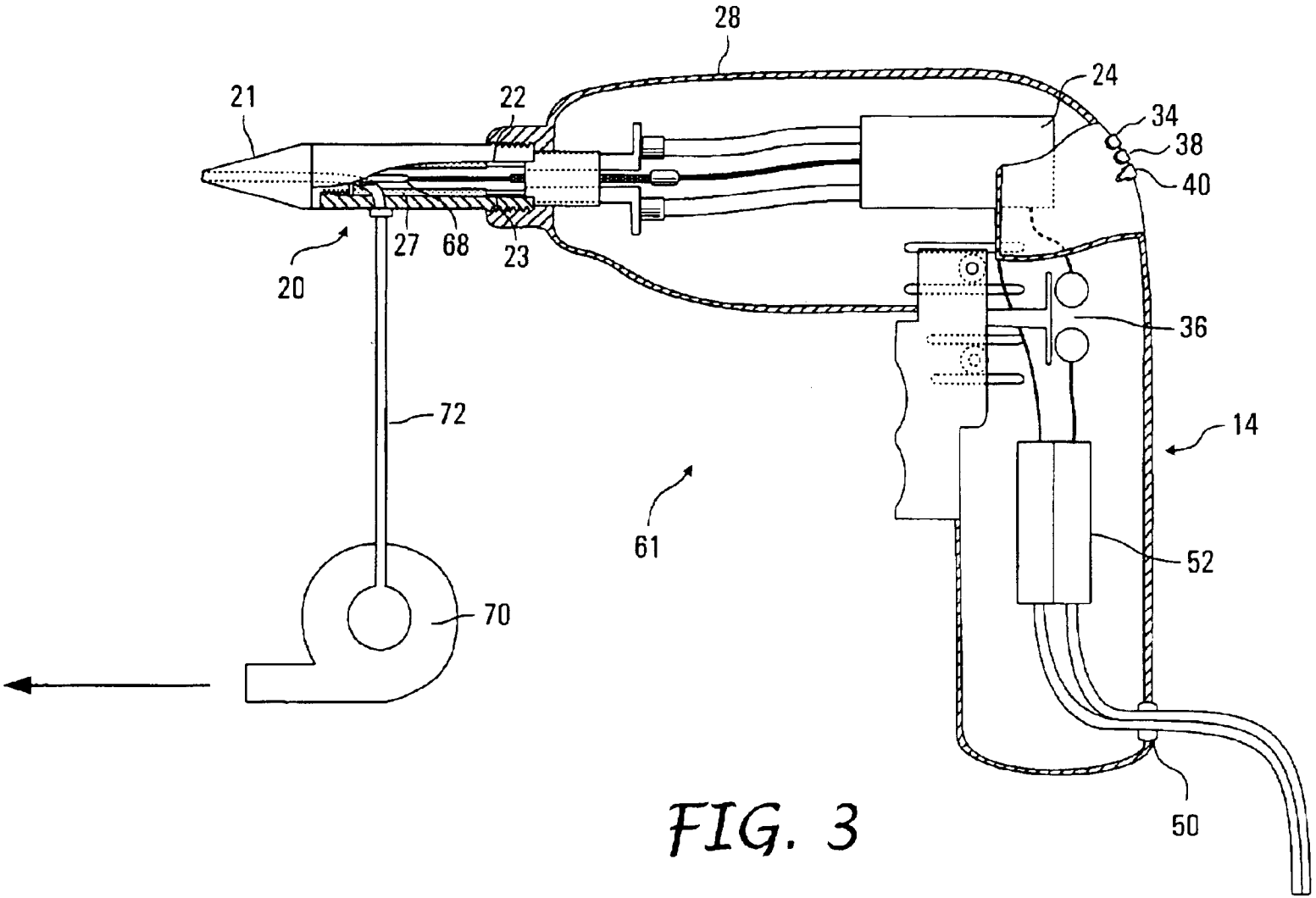
FIG. 3 depicts a desoldering appliance with vacuum assist for removing liquid solder from a workpiece which also comprises a pulsing circuit in accordance with exemplary embodiments of the present invention.

FIGS. 1A, 2A and 3 are perspective cutaway views of generic solder heating appliances, each appliance with a mechanism for adjusting the power duty cycle in accordance with an exemplary embodiment of the present invention. FIG. 1A shows a soldering gun with a resistive loop-type solder heating element; FIG. 2A illustrates a wand-type appliance with a resistive coiled resistive wire heating element, while FIG. 3 depicts a desoldering appliance with vacuum assist for removing liquid solder from a workpiece. In these and the following figures, corresponding elements will be labeled with like numbers for clarity.

Figure 1B:
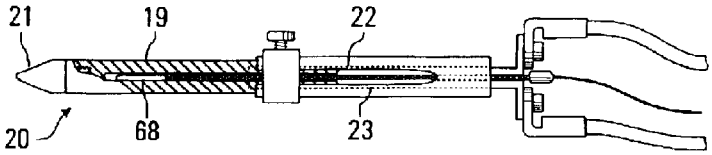
Figure 1C:
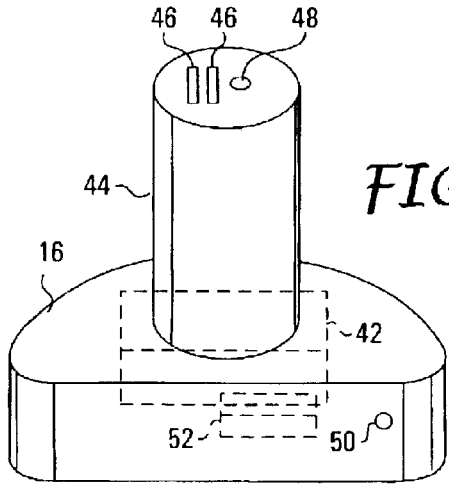

Referring now to FIGS. 1A–1C, a solder heating appliance is depicted in partial cutaway views as having a soldering gun body style with a resistive loop-type solder heating element. Appliance 10 is equally suited for heating solder for soldering or desoldering tasks. The depicted solder heating appliance 10 includes body portion 12, handle portion 14 and heating element 20. Solder heating appliance 10 may be operated either as portable unit using battery 42, or as a wired unit when electrically coupled to an AC current source. The distinction between the two embodiments will be described in greater specificity below. As shown, appliance 10 incorporates battery base portion 16 for electrical power, as such appliance 10 is depicted as being fully cordless and portable. It will be noted that mass center line 18 of each of hollow body portion 12, handle 14, and battery base 16 are all in alignment thus allowing unit 10 to be balanced and enabling the soldering appliance to stand alone on base 16. In addition, by aligning the mass center lines of elongated hollow body portion 12, handle 14 and base 16, and proper weight distribution of hollow body portion 12 and base 16, as can be done by those skilled in the art, balance is provided to enable the unit to be used with minimum strain on the arm and hand of the user. Contained partially within hollow body portion 12 are the electrical power circuit components for heating solder. In accordance with an exemplary embodiment of the present invention, the electrical power circuit components comprise pulsing circuit 24, heating element 20 and temperature sensor 68. With particular regard to the exemplary soldering gun-type appliance 10 depicted, heating element 20 is a resistive wire loop-type of heating element formed by resistance wire members 19 and tip 21. Heating element 20 is coupled to pulsing circuit 24 by wire members 19 through conductive barrels 22 and 23 interposed there between. Trigger mechanism 4 comprises manually actuated trigger 5 which cooperates with electrical switch 36 (S1) for alternatively coupling and decoupling pulsing circuit 24 to an internal battery, or alternatively, to a rectified AC power source (physical connections not shown). Switch 36 (S1) controls the power ultimately delivered to heating element 20, via pulsing circuit 24, in a manner which will be described below.

Handle 14 also has switch control pedestal 30 and mechanism 32, well known in the art, for locking battery/base unit 16 to handle 14. Switch pedestal 30 includes diode light 34, usually of green color but which may be of any desired color, while switch 38 (S2) increases the duty cycle or pulse widths from control circuit 24 to accommodate higher adhesive throughput. Modifying the operation of the duty cycle will be described in greater specificity below. Manual control switch 40 has multiple positions such as low, medium and high that can be selected by the user to designate the amount of heat to be produced by heating element 20. Alternatively, the positions on manual control switch 40 are preset for predetermined solder melting temperatures. For example, one position may be preset to correspond with 356° F. (180° C.) for using low temperature solders, another position preset between 392° F. and 446° F. (200° C.–230° C.) for solders having mid-range melting temperatures and still another position preset for high melting temperature solders, between 446° F. and 662° F. (230° C.–350° C.). Additionally, another position on manual control switch 40 may be preset for solders which melt above 662° F. (350° C.).

As depicted in FIG. 1A, soldering heat is generated by electrical current heating element 20, which is the wire loop-type element comprising wire members 19 which terminate at the distal end with tip 21, and are connected between barrels 22 and 23, respectively. Tip 21 may be removably affixed to heating element 20, although shown here as being permanently attached. Also included is sensor 68 which is juxtaposed to heating element 20. Prior art resistive wire loop heating elements are extremely prone to overheating failures due to the resistive wire loop reaching the point of incandescence, where the wire loop becomes so hot it radiates surplus kinetic energy through the emission of light. This incandescence occurs in a matter of seconds. In that state, it becomes harder for the atoms to maintain their physical positions because the added kinetic energy disrupts rigid bonds of the alloy. While it may take only a matter of 20 to 30 seconds for the tip to reach the point of incandescence, material failure comes about almost simultaneously with incandescence. To avoid element failures resulting from incandescence, the kinetic energy of the atoms in the wire loop must be kept below a certain level. Moreover, incandescence itself is an indication that the energy being delivered to the tip is not being efficiently consumed by heating solder, thus the tip is operating inefficiently at that level. Therefore, the position of sensor 68 along heating element 20 should be carefully chosen, usually on wire members 19 at a point where incandescence is most likely to occur, but as near the distal end of tip 21 as possible in order to capture an accurate value for the working temperature of tip 21.

FIG. 1B depicts an alternative tip configuration which operates essentially identical to that shown in FIG. 1A, and may be combined with the gun housing a electrical circuitry depicted in FIG. 1A. This tip configuration is more rigid than that shown in FIG. 1A, and is a somewhat more popular choice for commercial soldering/desoldering operations. Notice in this tip configuration that wire members 19 of heating element 20 are positioned closer together and clamped between barrels 22 and 23 forming a single heating appendage reminiscent of wand-type solder heating appliances, and further comprises removable tip 21. This tip configuration lends itself to more accurate temperature measurements because sensor 68 can be fitted in concave recesses between wire members 19.

With regard to either tip configuration, the current path across wire members 19, from barrel 22 to barrel 23, is very short and therefore the current being delivered to heating element 20 must be sufficiently high such that the $I^2R$ power across wire members 19 generates the prerequisite heat for melting solder. Consequently, the voltage across barrels 22 and 23 should be kept low in order to generate higher current with equivalent power. Usually, the voltage is set well below the 110V supplied from an electrical outlet, normally in the range of 1V to 15V, in order for sufficiently high current to be present to heat the wire loop-type element depicted as heating element 20. The implication of high current/low voltage operations should be considered when selecting each of the components in the electrical circuit of the appliance.

Figure 4:
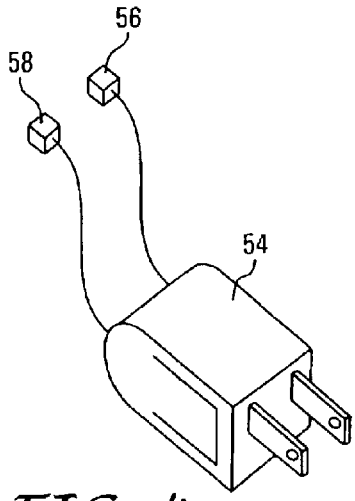
FIG. 4 is a schematic representation of a converter for supplying either AC or DC power to the battery for charging thereof in accordance with an exemplary embodiment of the present invention.

With regard to FIG. 1C, an exemplary base/power unit 16 is depicted which includes battery 42 and stem 44 that can be inserted into handle 14 of appliance 10 shown in FIG. 1A and electrical terminals 46 to be received by appropriate terminals (not shown) in the handle 14 of the solder heating appliance 10 illustrated in FIG. 1A. The battery/base 16 may be constructed such that stem 44 can be inserted in handle 14 in only. one direction. This may take many different forms such as slot 48 on one side of connectors 46. Other versions could be to shape the cross-sectional area of stem 44 to be inserted in a corresponding receptacle shape in handle 14 as shown in FIG. 1A. Battery/base 16 may include connector jack 50 for receiving a charging connector from the device in FIG. 4. Note in FIG. 4 that plug-in unit 54 could generate either AC or DC power output voltage on jacks 56 and 58. If the battery unit has its own rectifier unit 52, then jacks 56 and 58 in FIG. 4 may generate AC voltage. If the battery unit selected does not have rectifier 52, then plug-in unit 54 must be an AC to DC converter and jacks 56 and 58 would generate DC voltage. Here it should be understood that battery 42 may be any known, or heretofore unknown, type of power source without departing from the intended scope of the present invention. For example, battery 42 may be any of a dry cell, wet cell, alkaline, nickel-cadmium (Ni—Cad), fuel cell or any other chargeable or disposable portable source of AC or direct current (DC) power. Moreover, the power source need not be portable, but instead may be connected (wired) to any regulated source of AC or DC power, such as a typical 110-volt (60 hz) U.S. standard wall outlet or equivalent 220-volt (50 hz) international standard outlet. The power may originate from any generation source whatsoever. The weight of base 16 is in balance with the weight of the elongated body portion. Such balance can be easily achieved by those skilled in the art.

As stated previously, the charging connector may be an AC voltage from an alternating current source if battery/base 16 has rectifier unit 52. This would allow a unit to be charged while it is mounted on appliance 10, as well as an additional separate unit that can be charged at the same time. Moreover, appliance 10 is operable in three modes: as a portable unit using battery 42 as a power source; as a wired unit connected to an AC current source and using rectified AC current from rectifier unit 52 as a power source; or finally, as a wired unit connected to an AC current source but using battery 42 as a power source while simultaneously rectifying AC current from rectifier unit 52 and charging battery 42. It should be understood that, in any case, by utilizing the resistive wire loop type of heating element, the current delivered to the element should be relatively high with the voltage being low. These conditions may be achieved by providing rectifier unit 52 with a step-down transformer or the equivalent electrical component(s).

Referring now to FIG. 2A, a solder heating appliance is depicted in the partial cutaway views as having a wand-type body style with a resistive coiled resistive wire heating element. Many of the features of solder heating appliance 51 are identical to those discussed above and therefore only the unique features illustrated in the figures will be described in great detail. Solder heating appliance 51 is a wand-type which includes heating element 20, protective body portion 13 and handle portion 14. Wand-type appliance 51 may operated either as a portable unit using a battery, or as a wired unit when electrically coupled to an AC current source. As shown, appliance 51 is wired for receiving AC current directly from a power source. Contained within protective body portion 13 and handle 14 are the electrical power circuit components for powering heating element 20. In accordance with an exemplary embodiment of the present invention, the electrical power circuit components comprise pulsing circuit 24, heating element 20 and temperature sensor 68. The function of pulsing circuit 24 will be described below.

With more particular regard to heating element 20, soldering heating appliance 51 uses a coiled resistance wire-type of heating element comprising coiled resistive wire 25 and electrical leads 22 and 23. Heating element 20 is disposed within a thermally conductive tube which is adapted for receiving removable tip 21. Resistive wire 25 is coupled to pulsing circuit 24 through electrical leads 22 and 23, which are interposed there between. Typically, wand-type soldering appliances are the "always on" type of solder heating appliance which rests in a protective cradle/receptacle (not shown)when not in use. However, the wand-type appliance may be optionally fitted with a manually actuated trigger switch, or when incorporated as part of a soldering station, may be configured remotely from the wand at the base station or at a foot pedal (not shown).

Figure 2B:
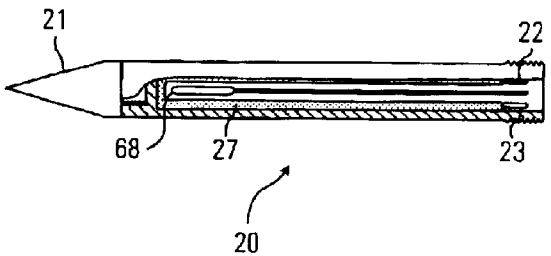

FIG. 2B depicts still another alternative tip configuration which utilizes a ceramic heating element, but operates essentially identical to that shown in FIGS. 1A, 1B and 2A. Commercial grade soldering/desoldering stations must be reliable and thermally stable, therefore the tend has been toward more exotic types of heating elements such as ceramics and more recently multi-element heaters and induction heating elements. With regard to FIG. 2B, heating element 20 is comprised of cylindrical ceramic heater 27 and electrical leads 22 and 23 which are electrically coupled to pulsing circuit 24, through which electrical current is delivered to ceramic heater 27. Heating element 20 is disposed within a thermally conductive tube which is usually adapted for receiving removable tip 21.

Still another type of solder heating appliance is used for desoldering components from PCB and the like. FIG. 3 is a partial cut-away view of a desoldering appliance having a gun body style with a ceramic heating element. More regularly, desoldering appliances are configured in soldering stations having a wand-type body style. Soldering appliance 61 is essentially a soldering appliance combined with a solder removal system; here the system includes hollow tip 21 which is channeled to vacuum pump 70 through routing tubing 72. Aside from the solder removal system, a desoldering appliance operates in much the same manner as any other soldering appliance and may be either the gun-type body or the wand-type body.

Desoldering appliance 61, similar to the other appliances described above, may be operated either as a portable unit using a battery, or as a wired unit when electrically coupled to an AC current source. As shown, appliance 61 is wired for receiving AC current from a power source. Contained within protective body portion 28 and handle 14 are the electrical power circuit components for powering heating element 20. In accordance with an exemplary embodiment of the present invention, the electrical power circuit components comprise pulsing circuit 24, heating element 20 and temperature sensor 68.

Figure 5A:
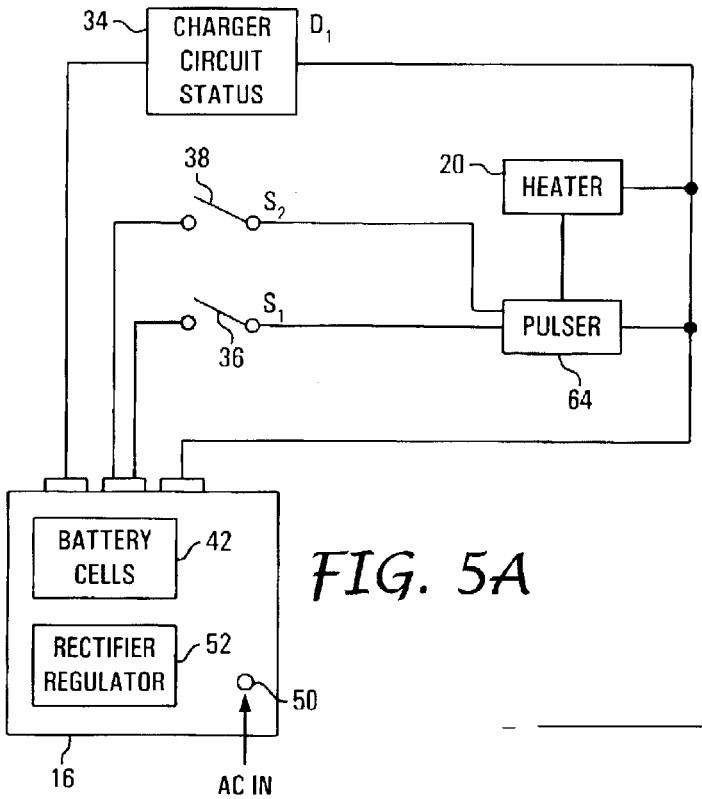
FIG. 5A is a block diagram of the control circuit for controlling the power to the blower fan and to the heating element in accordance with an exemplary embodiment of the present invention.

FIG. 5A discloses the basic electrical circuit for controlling power to the heating element. Basic circuit 62 includes battery base portion 16 with battery cells 42 therein and, if desired, rectifier unit 52. In accordance with an exemplary embodiment of the present invention, rectifier unit 52 may also include a step-down transformer for stepping down the voltage level and proportionally stepping up the current level prior to rectifying. It also has jack 50 for connecting a charger thereto. The transformer should be sufficiently rated to operate as a wired unit when jack 50 is connected to an AC current source and using rectified AC current from rectifier unit 52 as a power source for heater 20, via pulser circuit 64 (described as the second operational mode above). When the unit is plugged into a power source, the power is immediately supplied to LED 34 which indicates that the battery has sufficient power to operate the unit. When switch button 36 ($S_1$) is depressed, power is coupled to heating element 20 through a pulsing circuit 64, if desired. Switch button 38 ($S_2$) is a "super button." By depressing switch button 38 ($S_2$), the duty cycle or pulse widths from control circuit pulsing circuit 64 is increased to accommodate higher usage rates. Pulsing circuit 64 will be described hereafter.

Figure 5B:
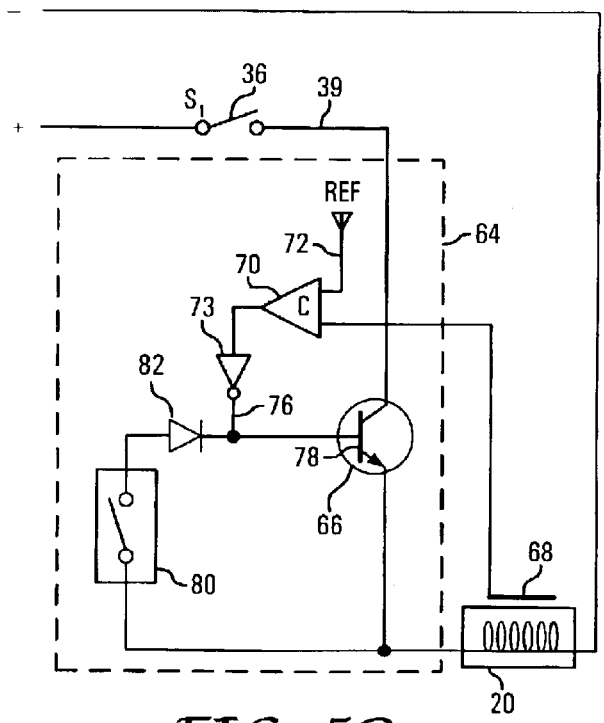
FIG. 5B is a circuit illustrating one circuit embodiment for quickly heating the heating element and then supplying pulsed current or voltage to maintain the heat in accordance with an exemplary embodiment of the present invention.

Pulsing circuit 64 is shown in detail in FIG. 5B. When the unit is first turned on and switch 36 ($S_1$) is depressed, the heating element is energized and it is desired that the heating element heat as quickly as possible. Thus, as shown in FIG. 5B, when switch 38 is closed, conductor 39 is coupled directly to the input of transistor 66. The temperature of heating element 20 is monitored by a temperature sensor, such as a thermocouple or thermistor. Temperature sensor 68 is coupled to comparator 70. Another voltage reference 72 is coupled to the other input of the comparator representing the proper or maximum heating temperature of element 20. Since there is no heat at first, there is no output from comparator 70. That lack of signal is detected by inverting diode 73 which generates an output signal on line 76 that is coupled to base 78 of power transistor 66 causing it to conduct. Transistor 66 is turned on by the signal on output line 76. Thus, full voltage is applied to heating element 20 to provide maximum heating in minimum time. As soon as the element is heated to the desired temperature, and that heat is sensed by sensor 68, an output signal is generated by comparator 70 that causes inverting diode 73 to remove its signal on output line 76, thus removing the continuous signal from the base 78 of transistor 66. At this time, pulser circuit 80, which is isolated from inverting diode 73 by isolating diode 82, provides pulses to base 78 of transistor 66 to maintain the heat attained by heating element 20 without having a continuous voltage applied thereto.

Figure 5C:
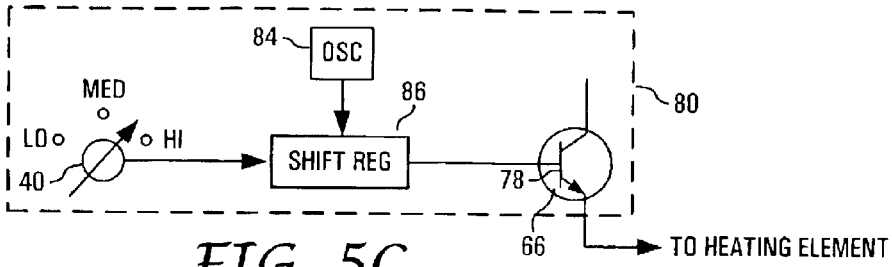
FIG. 5C illustrates the details of the pulsing circuit illustrated in FIG. 5B in accordance with an exemplary embodiment of the present invention.
Figure 5D:
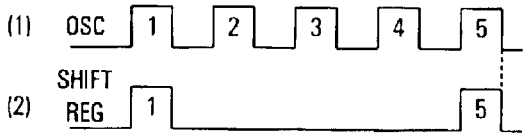
FIG. 5D illustrates in waveform 1 the oscillator output, and in waveform 2 the output of a circuit illustrating a 1:4 ratio for applying pulses to the heating element in accordance with an exemplary embodiment of the present invention.

Pulser circuit 80 is shown in detail in FIG. 5C in accordance with one exemplary embodiment of the present invention. Oscillator 84 applies pulses to circuit 86 that could be a shift register, a timer, a counter, or a divider circuit as shown in U.S. Pat. No. 4,571,588, which is incorporated herein by reference in its entirety. The duty cycle is the percentage of time a unit is used, or the ratio of operation time to shutdown time. If a device capable of only fixed-length pulses is used for controlling the duty cycle, then the ratio can be adjusted only by designating more or less pulses as operation pulses. If, however, the period of the pulses can also be altered, then the duty cycle can be altered by either increasing the ratio of the operation pulses to shutdown pulses, or by lengthening the duration of the operation pulses in the cycle. Thus, selecting a device having output pulse width modulation capability allows for adjusting the duration of the operation period as well as the ratio of operation periods. Many types of times and shift registers known in the art have pulse width modulation capabilities. In accordance with one exemplary embodiment, circuit 86 may be a 4-bit shift register as depicted in FIG. 5C. Input switch 40 is used for selecting select low, medium and high heat, causing a selected bit from one stage of circuit 86 to be connected to base 78 of transistor 66, thus causing transistor 66 to be pulsed on and off at a given rate. An example is illustrated in FIG. 5D. The oscillator is shown to have five pulses in waveform "1" of FIG. 5D, while circuit 86 generates an output pulse only once for every four input pulses as shown in waveform "2" which means there is a 4:1 ratio of the operating time of transistor 66. For every four pulses received by circuit 86, only one is gated to transistor 66 allowing transistor 66 to power heating element 20 only one-fourth of the time possible for heating (i.e., one-fourth of the duty cycle). The duty cycle may be increased by adding pulses or by increasing the pulse width of output of circuit 86.

Figure 5G:
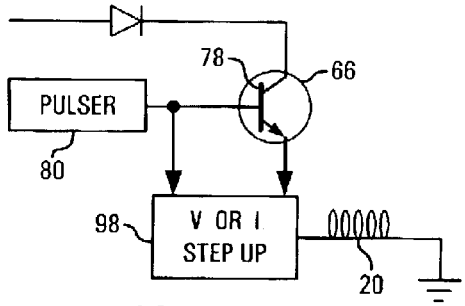
FIG. 5G illustrates a circuit for stepping up the voltage or current only during the time the pulses are applied to the heating element in accordance with an exemplary embodiment of the present invention.
Figure 5E:
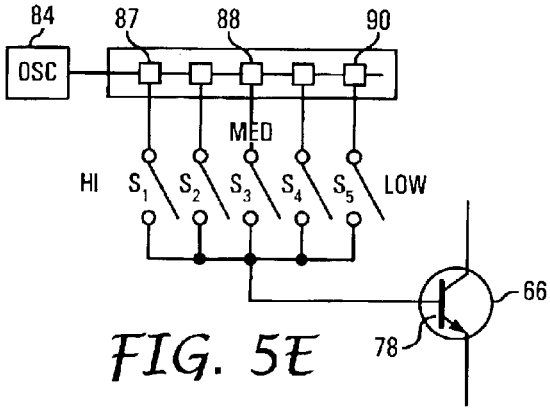
FIG. 5E is a schematic illustration of the output circuit with a manual switch control being set to high, medium and low to provide pulses and pulse ratios to the power transistor that supplies voltage and current to the heating element in accordance with an exemplary embodiment of the present invention.

Other ratios could be selected as illustrated by the circuit in FIG. 5E where oscillator 84 is feeding the pulses to circuit 86. At the output of each of the four stages or dividers of circuit 86, a switch ($S_1$–$S_5$) is connected to base 78 of transistor 66. If, for instance, switch $S_1$ is selected as the high heat position, then circuit 86, at stage 87, will produce an output with every pulse received and applied to base 78 of transistor 66. If stage 88 is selected by closing switch ($S_3$) or placing switch 40 in the medium position, then third stage 88 will be selected and a pulse will be generated through switch $S_3$ to base 78 of transistor 66 with every third pulse of the oscillator, or a 1:3 ratio. In like manner, if stage 90 is selected with selector position switch 40 in the low position, then every fourth pulse presented to circuit 86 will be counted and produced through switch $S_5$, the low position, to base 78 of transistor 66, thus having a 1:4 heating ratio. It can be readily seen that such a circuit cannot only control the amount of heat generated by heating element 20, but also maintain the heat with less power requirements since it simply adds enough heat at periodic intervals to maintain a given heat. Thus, power is saved and the unit is more economically efficient and the battery life is prolonged. Implementing a duty cycle has an additional benefit that is not immediately apparent, that is, extending appliance life. Because the heating element is not operating the full time period the appliance is switched on, the useful life of the heating element is extended.

Figure 5H:
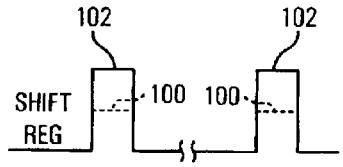
FIG. 5H illustrates the stepped-up voltage pulses that are applied to the heating element by the circuit of FIG. 5G in accordance with an exemplary embodiment of the present invention.
Figure 5F:
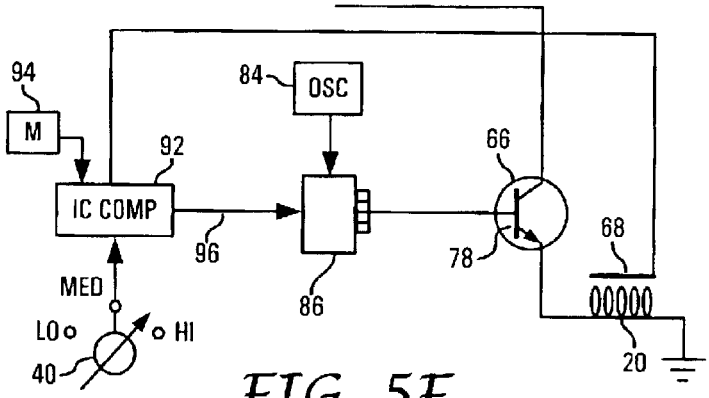
FIG. 5F illustrates a circuit for supplying pulses to the power transistor to automatically maintain a desired heater temperature utilizing an innovative control circuit in accordance with an exemplary embodiment of the present invention.

In accordance with still another exemplary embodiment of the present invention, automatic temperature control of heating element 20 is achieved through the circuit depicted in FIG. 5F. As can be seen in FIG. 5F, an integrated circuit controller 92 is added as an integrated circuit chip with memory 94 that stores a table comparing detected temperature versus counter 86 output. When hand controller 40 is set to a position of low, medium or high, that position is detected by integrated circuit controller 92 which then compares the temperature table with the actual temperature received from sensor 68 and through line 96 causing the proper output of counter 86 to be applied to the base of transistor 66 to supply the proper voltage or current to heating element 20 to cause it to reach the set temperature. The table in memory 94 stores temperature to count maps for each position on manual control switch 40. For example, one position may be preset to correspond with 356° F. (180° C.) for using low temperature solders; another position manual control switch 40 may be preset between 392° F. and 446° F. (200° C.–230° C.) for solders having mid-range melting temperatures and still another position preset for high melting temperature solders, between 446° F. and 662° F. (230° C.–350° C.). Additionally, another position on manual control switch 40 may be preset for solders which melt above 662° F. (350° C.). Alternatively, the table in memory 94 may store temperature to count map based on the desired temperature associated with each position on manual control switch 40. In that case, the greater the differential between the actual temperature, as detected by sensor 68, and the desired temperature, as indicted by the position of manual control switch 40, the longer the duty cycle. This allows for rapid recovery for higher usage and substantially increases throughput.

In accordance with another exemplary embodiment of the present invention, current or voltage to the heating element may be increased during the time the pulse is applied through transistor 66. Thus, in FIG. 5G, each time pulser circuit 80 applies a pulse to base 78 of transistor 66, it also applies a pulse to a voltage or current step-up device 98 to increase the current or voltage to heating element 20. Such voltage step-up device could be, for instance, a piezoelectric device, well known in the art, that, when voltage is applied to the device in one direction, causes a step-up voltage that may be detected in another direction of the piezoelectric device. Voltage and current step-up devices are well known in the art and will not be described in any further detail here. Optionally, device 98 may be selectively activated by coupling a switch, such as switch 36, ($S_2$) between pulser 80 and device 98, thereby activating voltage and current step-up device 98 only after manual intervention by the operator. Alternatively, device 98 may be activated automatically based on the temperature of heating element 20, proximate to tip 21, as sensed by sensor 68.

FIG. 5H illustrates how the pulse is increased in magnitude. Normally, the pulse is at height 100, but a step-up to height 102 is caused by step-up unit 98. This increases the speed of heating of the element to the desired temperature. Further, to maintain a desired heat with such increased pulse could mean that a higher pulse ratio could be used. That is, for example only, one pulse out of five instead of one pulse out of three or four could be used.

While the present invention has been described with reference to an exemplary solder heating appliance having various types of heating elements, one of ordinary skill level in the relevant art would readily understand that the principles and concepts discussed herein are equally relevant for other types of appliances and heating elements. One such appliance is an industrial solder heating appliance which holds bulk solder in a reservoir and forces the liquefied solder to a dispensing gun through an tubing hose and onto a workpiece. The techniques described herein with regard to the present invention may be incorporated in the solder reservoir of such an appliance. Moreover, the dispensing gun often contains a secondary heating element for re-heating the solder to the ideal temperature for application onto a workpiece. In those cases, both the primary heating element of the solder reservoir and the secondary heating element in the dispensing gun may be controlled by pulse circuits as described hereinabove.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A solder heating appliance with adjustable duty cycle comprising:

a body portion;

at least one electrical heating element associated with the body portion, the at least one electrical heating element for radiating heat to the solder;

a power source electrically coupled to the at least one electrical heating element, wherein the power source provides power to the at least one electrical heating element;

a sensor for sensing the at least one electrical heating element temperature and generating a corresponding signal;

a comparator circuit for comparing a reference signal to the sensor generated corresponding signal and generating a first output signal only until a comparison is made and only then ceasing to generate the first output signal and generating a second output signal; and a pulsing circuit, including a power transistor electrically coupled between the power source and the at least one electrical heating element, the power transistor further having a trigger electrically coupled to the comparator for receiving the first output signal, wherein the power transistor provides continuous power to the at least one electrical heating element only as long as the first output signal from the comparator is received at the trigger.

2. The solder heating appliance of claim 1 wherein the pulsing circuit further comprises:

the power source being coupled to an input of the power transistor and the at least one heating element being electrically coupled to an output of the power transistor, and a pulse generating circuit electrically coupled to the trigger of the power transistor for providing variable duty cycle output pulses to the trigger of the power transistor at a selected one of a plurality of on/off rates that provides adjustable power to the at least one electrical heating element to maintain a desired heating element temperature only when the second output signal is generated by the comparator.

3. A solder heating appliance as in claim 1 further comprising:

the power transistor having one input electrically coupled to the power source, and an output electrically coupled to the at least one electrical heating element;

a pulse generating circuit electrically coupled to the trigger of the power transistor for providing adjustable duty cycle output pulses to the trigger of the power transistor to cause the power transistor to conduct at an alterable on/off rate for providing adjustable power to the at least one electrical heating element to maintain a desired element temperature only when the second output signal is generated by the comparator; and a single manual temperature control coupled to the pulse generating circuit for selecting one of the power transistor adjustable on/off rates that provides adjustable power to the at least one electrical heating element based on the selected on/off rate.

4. The solder heating appliance of claim 2 further comprising a single manual control coupled to the pulse generating circuit for selecting a desired one of the plurality of on/off rates for providing adjustable power to the at least one electrical heating element.

5. The solder heating appliance of claim 2 wherein the pulse generating circuit further comprises:

an oscillator circuit for generating sequential pulses;

a circuit for receiving the sequential pulses, the circuit comprising a plurality of serial stages, each of the plurality of serial stages generating an output pulse in response to receiving a particular pulse in the sequential pulses;

a plurality of multiple position switches, each of the plurality of multiple position switches electrically coupled between one of the plurality of serial stages an the trigger of the power transistor; and switch positioning means for positioning at least one of the plurality of multiple position switches for passing at least one of the output pulses from one of the plurality of serial stages to the trigger of the power transistor at the selected one of the plurality of on/off rates.

6. The solder heating appliance of claim 3 wherein the pulse generating circuit further comprises:

an oscillator circuit for generating sequential pulses;

a circuit for receiving the sequential pulses, the circuit comprising a plurality of serial stages, each of the plurality of serial stages generating an output pulse in response to receiving a particular pulse in the sequential pulses;

a plurality of multiple position switches, each of the plurality of multiple position switches electrically coupled between one of the plurality of serial stages and the trigger of the power transistor; and switch positioning means for positioning at least one of the plurality of multiple position switches for passing at least one of the output pulses from one of the plurality of serial stages to the trigger of the power transistor at the selected one of the plurality of on/off rates.

7. The solder heating appliance of claim 2 further comprising; a single manual temperature control means for selecting a desired element temperature; and an integrated circuit controller having a memory and a table stored in the memory indicating at least one electrical heating element temperature versus pulse rate, the integrated circuit controller receiving the manually selected desired element temperature and selecting a corresponding pulse rate from the stored table to generate a pulse rate control signal to the trigger of the power transistor for controlling the on/off rate of the power transistor to maintain the desired heating element temperature.

8. The solder heating appliance of claim 3 further comprising:

the single manual temperature control means for selecting a desired element temperature; and an integrated circuit controller having a memory and a table stored in the memory indicating at least one heating element temperature versus pulse rate, the integrated circuit controller receiving the manually selected desired element temperature and selecting a corresponding pulse rate from the stored table to generate a pulse rate control signal to the trigger of the power transistor for controlling the on/off rate of the power transistor to maintain the desired heating element temperature.

9. The solder heating appliance of claim 5 further comprising:

the single manual temperature control means for selecting a desired element temperature; and an integrated circuit controller having a memory and a table stored in the memory indicating heat element temperature versus pulse rate, the integrated circuit controller receiving the manually selected desired element temperature and selecting a corresponding pulse rate from the stored table to generate a pulse rate control signal to the trigger of the power transistor for controlling the on/off rate of the power transistor to maintain the desired heating element temperature.

10. The solder heating appliance of claim 9 further in the pulse rate control signal from the stored table for controlling the power transistor on/off pulse rate forms the switch positioning means for positioning at least one of the plurality of multiple position switches to provide the selected one of the plurality of on/off pulse rates.

11. The solder heating appliance of claim 6 further comprising:

a single manually operated control means for selecting a desired heating element temperature and generating a signal representing the selected desired temperature; and an integrated circuit controller having a memory and a table storing data in the memory indicating selected heating element temperatures versus pulse rates;

the integrated circuit controller coupled to the heat sensor for receiving the corresponding signal, and coupled to the single manual temperature control means for receiving the manually selected desired heating element temperature such that stored data in the memory of the integrated circuit controller generates a control signal for controlling the onto pulse rate to the trigger of the power transistor to maintain the manually selected temperature.

12. The solder heating appliance of claim 11 wherein the stored data generated control signal for controlling the on/off pulse rate forms the switch positioning means for positioning at least some of the plurality of multiple position switches for designating the power transistor on/off rate.

13. The solder heating appliance of claim 4 further comprising:

a voltage step-up circuit coupled between the power transistor and the at least one electrical heating element and coupled to the pulse generating circuit in parallel with the power transistor for receiving the desired on/off pulse rate, the voltage step-up circuit providing a voltage step-up to the at least one electrical heating element synchronously with the trigger of the power transistor receiving pulses at the desired on/off pulse rate.

14. The solder heating appliance of claim 3 further comprising:

a voltage step-up circuit coupled between the power transistor and the at least one electrical heating element and coupled to the pulse generating circuit in parallel with the power transistor for receiving the desired on/off pulse rate, the voltage step-up circuit providing a voltage step-up to the at least one electrical heating element synchronously with the trigger of the power transistor receiving pulses at the desired on/off pulse rate.

15. The solder heating appliance of claim 1 wherein the power source contains at least one rechargeable battery.

16. The solder heating appliance of claim 15 wherein the battery supplies at least 14 volts to the solder heating appliance.

17. The solder heating appliance as in claim 15 further comprising:

an AC/DC rectifier circuit forming part of the power source; and the AC/DC rectifier receiving the output of an AC charging circuit for enabling DC voltage to be generated for charging the at least one battery.

18. A method of applying power to at least one electrical heating element in a solder heating appliance comprising the steps of:

applying continuous power to a heating element in a solder heating appliance to achieve a desired operating temperature;

using a single manual control means to maintain the desired operating temperature for the heating element;

selecting one of multiple duty cycles to cause pulsing of the continuous power applied to the heating element based on the selected desired operating temperature; and pulsing the continuous power applied to the heating element with the selected duty cycle sufficient only to maintain the selected desired operating temperature.

19. A method of applying power to a load to achieve a desired load output comprising the steps of:

applying continuous power to the load to achieve the desired load output;

utilizing a single manual control to maintain the desired load output by selecting one of multiple duty cycles to cause pulsing of the continuous power applied to the load based on the selected desired load output; and pulsing the continuous power applied to the load with the selected duty cycle sufficient only to maintain the desired load output.

* * * * *